US006370848B1

(12) United States Patent
Cramer et al.

(10) Patent No.: US 6,370,848 B1
(45) Date of Patent: Apr. 16, 2002

(54) PROCESS AND DEVICE FOR PACKAGING MATERIAL WEB ROLLS

(75) Inventors: Dirk Cramer, Duisburg; Ludger Goddemeier, Tönsivorst; Volker Schölzke, Krefeld, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/379,514

(22) Filed: Aug. 23, 1999

(30) Foreign Application Priority Data

Aug. 21, 1998 (DE) ..... 198 37 981

(51) Int. Cl.[7] ..... B65B 11/00
(52) U.S. Cl. ..... 53/461; 53/587
(58) Field of Search ..... 53/399, 462, 461, 53/465, 64, 581, 587, 389.3, 389.4, 513, 522, 118, 430, 435; 83/949, 952, 175, 176, 509

(56) References Cited

U.S. PATENT DOCUMENTS

| | | | | | |
|---|---|---|---|---|---|
| 3,377,033 | A | * | 4/1968 | Link | 53/399 |
| 4,671,043 | A | * | 6/1987 | Forni et al. | 53/399 |
| 5,257,567 | A | * | 11/1993 | Walker et al. | 83/74 |
| 5,282,350 | A | * | 2/1994 | Crowley | 53/435 |
| 5,513,478 | A | * | 5/1996 | Abt | 53/118 |
| 5,690,601 | A | * | 11/1997 | Cummings et al. | 83/407 |
| 5,758,842 | A | | 6/1998 | Dorfel et al. | |
| 5,768,858 | A | | 6/1998 | Hannen | |
| 5,966,904 | A | * | 10/1999 | Peters | 53/399 |
| 6,044,619 | A | * | 4/2000 | Kayser et al. | 53/399 |
| 6,053,086 | A | * | 4/2000 | Smyth | 83/648 |
| 6,092,452 | A | * | 7/2000 | Adami | 83/428 |

FOREIGN PATENT DOCUMENTS

| | | |
|---|---|---|
| DE | 19535746 | 5/1998 |
| DE | 19717249 | 10/1998 |
| EP | 873940 | 10/1998 |
| FR | 1055390 | 2/1954 |
| FR | 2617122 | 12/1988 |
| WO | 95/13980 | 5/1995 |

* cited by examiner

*Primary Examiner*—Scott A. Smith
*Assistant Examiner*—John Paradiso
(74) *Attorney, Agent, or Firm*—Greenblum & Bernstein, P.L.C.

(57) ABSTRACT

Device and process for the production and packaging of material web rolls. The device includes a slitting station configured to slit a material web into a plurality strips and a winding bed adapted to accommodate a stack of individual material web rolls next to one another. Also included is a packaging web dispenser adapted to travel, in at least one direction, parallel to the axis of the stack of individual material web rolls, and further adapted to dispense a packaging web at a predetermined angle to a circumferential direction of rotation of the stack of individual material web rolls. Additionally, a cutting device adapted to cut the packaging web parallel to the end faces of the material web roll is provided. The process of the invention includes helically wrapping the web rolls with a packaging web and cutting the packaging web at each position corresponding to the end faces of the material web rolls with the aid of the cutting device.

19 Claims, 3 Drawing Sheets

PROCESS AND DEVICE FOR PACKAGING MATERIAL WEB ROLLS

CROSS-REFERENCE TO RELATED APPLICATIONS

The present invention claims priority under 35 U.S.C. §119 of German Patent Application No. 198 37 981.1, filed on Aug. 21, 1998, the disclosure of which is expressly incorporated by reference herein in its entirety.

BACKGROUND OF THE INVENTION

1. Field of the Invention

The present invention relates to a process and device for the production and packaging of material web rolls, and more particularly, to a device having a slitting station for slitting a material web into several strips, and further having a winding bed for accommodating a stack of material web rolls arranged next to one another.

2. Discussion of Background Information

In one of the final manufacturing steps, a paper web is wound into a transportable winding roll and is then packaged. It is necessary to slit the finished paper web to a certain width during this process. Paper webs are manufactured in fairly large widths of up to approximately 10 meters (m). However a consumer (e.g., a printer), only needs a roll width of up to a current maximum of approximately 3.8 m. In many cases, rolls have an even smaller width, down to approximately 0.8 m. Accordingly, the paper web is unwound from a master roll having a large width, runs first through a slitting device that produces web subsections which are then wound up into the individual winding rolls. The rolls have diameters in the range from approximately 1 to 2.5 m.

Once the material web rolls have been wound, they still must be packaged. These rolls are customarily ejected from the winding station and delivered to a packaging station, where they are wrapped in a packaging web. As soon as the rolls have been ejected, the winding station can again be prepared for the accommodation of new material web rolls (e.g., winding tubes can be inserted onto which the material web strips can be wound).

Because of long setup times required, a single winding station is not normally enough for the manufacture of material web rolls. Such a single helical winding roll packaging is described in German patent document No. DE 19535 746 C2. However, two winding stations often wastefully provide too great a capacity. Thus, the winding stations often operate with excess capacity.

SUMMARY OF THE INVENTION

The present invention provides a device and process for the production and packaging of material web rolls. The device includes a slitting station configured to slit a material web into a plurality of strips and a winding bed adapted to accommodate a stack of individual material web rolls next to one another. Also included is a packaging web dispenser adapted to travel, in at least one direction, parallel to the axis of the stack of individual material web rolls, and further adapted to dispense a packaging web at a predetermined angle to a circumferential direction of rotation of the stack of individual material web rolls. Additionally, a cutting device adapted to cut the packaging web parallel to the end faces of the material web roll may be provided.

Also, the packaging web dispenser may be adapted to travel in two directions parallel to the axis of the stack.

The packaging web dispenser may be arranged on a rail above the winding bed, and the cutting device may be also be arranged on the rail. Also, the cutting device may have a circular blade adapted to be moved at least toward the stack in a generally radial direction. Further, the circular blade may move away from the stack in a generally radial direction Additionally, the rail may carry a loading roller which forms a nip with the stack of individual material web rolls during winding, and the nip may be adapted to accept the packaging web therethrough.

The packaging web and the material web may further travel along at least a portion of the same path.

Also, the cutting device may be formed by the slitting station. Additionally, the slitting station may include a sensor adapted to detect the passage of a leading side edge of the packaging web.

The circular blade may be further adapted to be moved away from the stack in a generally radial direction.

The process of the present invention includes winding the material web rolls about an axis, from strips created by a longitudinal slit, helically wrapping a packaging web about the circumference of the stack of material web rolls, the stack of material web rolls being in substantially the same position in which they are wound. The process also includes separating the packaging web at a position corresponding to the respective end faces of each material web roll.

The process may further include guiding the packaging web from before one roll stack end face, to past another roll stack end face, and cutting the packaging web parallel to the roll stack end faces.

Additionally, the process may include cutting the packaging web located on the circumference of the roll stack.

Further, the process may include cutting the packaging web after completion of packaging.

Also, the process may include cutting the packaging web as it is supplied, coordinating the feed rate of the packaging web with the movement of the packaging web parallel to the axis of rotation of the stack, and forming at least one separating line parallel to the end faces of the individual material web rolls.

Further, the packaging web may be passed through the same slitting device through which the material web passes.

The process may yet still further include holding together, at least in the region of a leading edge of a packaging web, adjacent packaging web sections on both sides of the separating line.

The present invention packages material web rolls in a cost-effective manner.

In the present invention, the circumference of the material web rolls lying next to one another are in the form of a horizontal stack, in the same positions as for winding, and the rolls are wrapped by a packaging web guided about the stack in a helical curve. The packaging web is separated at each position corresponding to the end faces of the material web rolls.

This configuration has several advantages. The winding station can be used to produce the circumferential packaging of the material web rolls. Not only are the material web rolls rotated during winding, but are also rotated during the application of the packaging web, which is drawn onto the circumference as the material web rolls rotate. Since this rotary drive for the material web rolls must already be used for winding, the rotary drive may also be used for creating the circumferential packaging.

The present invention also advantageously uses a special packaging web guide. Because the packaging web is wound about the stack in the form of a helix, only a single strip of packaging web is needed, regardless of the width (i.e., the axial length) of the stack. The invention may further advantageously be used when the widths of the material web rolls vary a great deal and/or are significantly larger than the width of the packaging web. With a relatively large stack, the packaging merely takes a little longer because the helical curve is longer, but the process remains the same. It is only necessary to cut the packaging web at the end faces of each material web roll so that the web rolls may be handled individually. If a number of material web rolls, for example, two, are combined in one shared package, then it is not necessary to make a cut at each end face of the material web rolls, but rather only in those locations where one wishes to separate groups of material webs from one another. Once the circumference of the material web rolls has been packaged and the material web rolls are available individually or in groups, they can be ejected from the winding station and transported to an end face packaging unit. During this transport, however, the circumference of the material web rolls is already protected so that the risk of subsequent damage during transport is kept to a minimum. At the end face packaging unit, end covers may be applied. If necessary, an edge strip can additionally be used to protect the edges of the material web roll and/or to hold the end covers in place. Application of the end covers is greatly simplified in that the circumferential packaging virtually terminates at the end faces of the material web rolls.

The packaging web may be guided completely from one end face to another end face of the stack, where the packaging web is cut parallel to the end faces. Due to the helical travel of the packaging web, the packaging may not have the same outside diameter everywhere along the stack, which can lead to problems during transport if the material web rolls are to be rolled on their circumference. However, if the packaging web is guided beyond the outer end faces and the at least three-cornered endpiece that forms thereat is cut off, this problem does not arise. It is thus not necessary to fold in an endpiece or projecting end, which would otherwise make any desired pile stacking more difficult.

The packaging web located on the circumference of the stack may cut. This feature is advantageous in that the position where cutting is necessary does not have to be changed relative to the packaging web. Thus, no additional complicated control processes are required. The position where cutting occurs is located where two material web rolls are adjacent to one another. Customarily, a gap of a few millimeters is provided at this region, into which a cutting device can enter without damaging the material web roll.

Cutting becomes especially easy when the packaging web is cut after completion of the circumferential packaging. Thus, individual packaging steps are unnecessary. First, the circumferential wrapping of the entire stack is completed. During this process, the individual bands of the packaging web, which overlap, are adhered to one another. Once the "sleeve" is finished, the individual material web rolls can again be separated in another step.

In a second embodiment, the packaging web may be cut as it is supplied, where the feed rate of the packaging web and its movement parallel to the axis of the stack's rotation are coordinated such that a separating line is formed parallel to the respective end faces of the material web rolls. Because the packaging web is wrapped in a helix about the circumference of the stack, it is necessary to coordinate the feed rate of a packaging web dispenser parallel to the axis of rotation of the stack, with the circumferential velocity of the stack, such that the surface area of the packaging web is dispensed onto the stack in the circumferential direction of rotation. If there are additional components in the axial direction, wrinkles would otherwise form. However, this control system can be utilized in such a way that cuts or separating lines are generated such that, while the lines or cuts are diagonal relative to the packaging web, they are parallel to the end faces of the material web rolls.

Also, the packaging web may pass through the same slitting device as the material web. Thus, the packaging web for each material web roll has the same axial length as the material web roll. As a result, troublesome projecting ends, as well as uncovered sections of material web rolls are eliminated.

Adjacent packaging web sections may be held together on both sides of the separating line, at least at the region of a leading lateral edge of the packaging web. The initial application of the packaging web to the circumference of the stack is easily accomplished. Problems do not arise when the packaging web is wound about the circumference of the stack without a separating line. However, when separating lines are generated, relatively sharp triangular endpieces are created at the beginning of each packaging web section that wraps a material web roll. The handling of this "endpiece" requires some consideration. Handling may be facilitated by holding the two adjacent sections of the packaging web together at least at the apex distance of this endpiece (i.e., on the side edge adjacent to the stack). This "holding together" can be accomplished, for example, by not cutting the packaging web for a short distance. The "holding together" can also be accomplished in that the separating line may be formed by a perforation. Also, an adhesive strip can also be used, so that the end of one packaging web pulls the beginning of the next packaging web along with it, so to speak. The short connecting piece between adjacent packaging web sections causes no harm. It will be torn off, at the latest, when the material web rolls are ejected from the winding bed.

The packaging web dispenser is capable oftravel parallel to the axis of rotation of the stack, in two directions, and dispenses a packaging web at a predetermined angle to the circumferential direction of rotation of the stack. A cutting device is also provided, which cuts the packaging web parallel to the end faces of the material web roll.

The helical winding of the packaging web is accomplished by the packaging web dispenser dispensing the packaging web at a predetermined angle to the circumferential direction of rotation of the stack. The dispenser is laterally movable in two directions parallel to the axis of rotation of the stack. The material web rolls (or the stack) are rotated in the winding bed. Thus, the winding bed serves a dual purpose, thereby avoiding idleness of the bed. In addition, the present invention provides a relatively low-cost solution for dispensing a packaging web. Further, only one packaging web size need be kept on hand, regardless of the axial length of the material web roll stack to be packaged.

The packaging web dispenser may be arranged on a rail above the winding bed. This design has several advantages. Such a rail is already present in most material web winding stations, since winding stations generally utilize a pressure roller to generate the necessary nip pressure and the required winding tightness and hardness at the start of a winding process. However, this rail is often only used at the start of winding. If the material web rolls are also packaged in the winding bed, the rail can be used for guiding the packaging web dispenser which would have otherwise had no purpose. Also, the arrangement of the packaging web dispenser above the material web rolls to be packaged is advantageous in that the beginning of the packaging web hangs down because of gravity and thus can easily be guided to the circumference of the material web roll stack with relative ease.

The cutting device may be arranged on the rail, whereby the rail may thus provide a third function. The cutting device preferably has a circular blade that is generally radially movable toward and away from the stack. The circular blade "rolls" with its sharp edge on the circumference of the packaged material web rolls, cutting through the packaging web. It is not necessary for the circular blade to cut through all layers of the packaging web in a single cut. It is also possible to rotate the stack when cutting the packaging web until the blade has penetrated all layers. The position of the circular blade must align in registry with the position of slitting station blades. If necessary, the cutting process can be automated, for example, through a shared control device that determines the positions of the blades in the slitting station and the circular blades in the cutting device.

The rail may carry a loading roller, which, during packaging, forms a nip with the stack through which the packaging web runs. A loading roller is already present in many winding devices, as explained supra. The loading roller may additionally be used to press the packaging web against the circumference of the material web roll during wrapping.

In a second embodiment, provision is advantageously made for the packaging web to have the same web path, at least in part, as the material web. For example, this arrangement allows the tension in the outer layers of the material web rolls and the tension in the packaging web to be matched so that no damage is caused by respective differences in tension. Moreover, dual use can be made of guide devices that are required for guiding the material web or the strips.

It is also advantageous if the cutting device is formed by the slitting station. The circumferential wrapping of the individual material web may thus have approximately the same width as the material web rolls themselves (e.g., the width of the strips) despite use of a helical packaging process.

It is further advantageous if the slitting station has a sensor that detects the passage of the leading side edge of the packaging web. Using the sensor, additional measures may be taken to re-attach the packaging web in the region of the leading edge. Further, the device can be configured so that the blade does not cut through the packaging web at all. If, for example, the slitting station works with top and bottom blades, it is possible to configure the device to wait to bring the top and bottom blades together until after the packaging web has run through the slitting section. The two packaging web sections may then remain connected over a distance of a several centimeters, which is inconsequential because this connection tears apart when the material web rolls are ejected from the winding bed.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
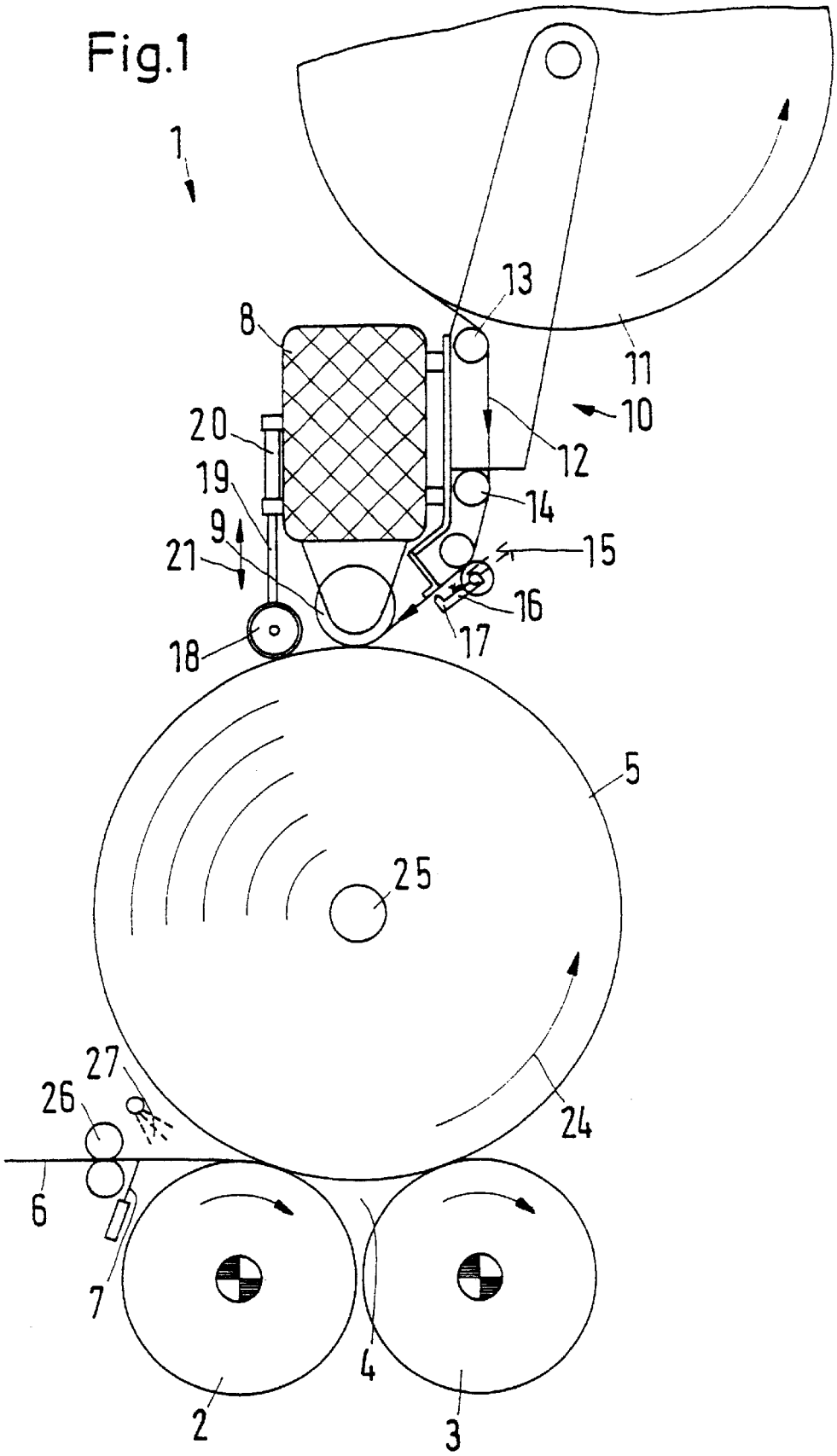
FIG. 1 shows a side elevational view of a device for winding and packaging material web rolls.

Referring to the drawings wherein like numerals represent like elements, the device for packaging material web rolls 1 shown in FIG. 1 has two carrier rolls 2, 3 (also called "king rolls"), which together form a winding bed 4 in which a material web roll stack 5 (in the present case a paper roll) is located. More precisely, located in the winding bed 4 (shown in FIG. 3) are a number of material web rolls 5A, 5B, 5C coaxial to one another (e.g., their end faces are parallel and adjacent to one another) and the rolls have the same or parallel axes of rotation.

A material web 6 that has been cut in several parallel strips is wound onto the material web roll stack 5. The slitting device is not shown in detail in FIG. 1. The material web 6 is cut, for example, with the aid of a cut-off knife 7, which is shown schematically in FIG. 1. The material web 6 is set up for the start of a new winding roll and is held in position by a clamping device 26.

During winding of the material web roll stack 5, the material web roll stack 5 is driven by the two driven carrier rolls 2, 3.

A rail 8, known as a "loading rail" is arranged above the winding bed 4, on the other side of the material web roll stack 5. The rail 8 carries a pressure roller 9 on its underside. The rail 8 is adjustable in height in a manner not shown in detail. At the start of the winding process, the pressure roller 9 presses the forming material web roll stack 5 into the winding bed 4 to achieve higher winding hardness and tightness at the start of winding.

Arranged on the rail 8 is a packaging web dispenser 10, which is movable along the rail 8 parallel to the rotational axis of the material web roll stack 5. The packaging web dispenser 10 carries a packaging web roll 11 (e.g., a wrapping paper roll) having a maximum diameter of approximately 1,500 mm and a width of approximately 500 mm.

The packaging web roll 11 dispenses a packaging web 12, which, for example, may be made of wrapping paper. The packaging web 12 is guided by several deflection or guide rollers 13, 14 into a pinch roll gap created by a pair of pinch rollers 15, whereupon it is fed through the nip between the pressure roller 9 and the material web roll stack 5.

An adhesive application device 16 is provided between the pinch rollers 15 and the material web roller 5. A cut-off device 17 is provided downstream of the adhesive application device 16.

A circular blade 18 is located on a ram 19 of a piston/cylinder device 20 in the circumferential direction behind the pressure roller 9. The circular blade 18 can be adjusted in the direction of the double arrow 21 so that it moves generally radially toward the material web roll stack 5 or away from it.

The packaging web 12 is dispensed so that a side edge 22 thereof forms an acute angle (shown in FIG. 3) with the circumferential direction 23 of the material web roll stack 5. The material web roll rotates in the direction of an arrow 24 and the packaging web dispenser 10 moves in a direction generally parallel to the axis of rotation of the material web roll stack 5, thereby producing a helical packaging about the web roll.

The operation of the material web roll packaging device 1 will hereinafter be described. When the individual material web rolls 5A, 5B, 5C are nearly fully wound, the winding speed is reduced to zero. With the aid of the cut-off knife 7, the material web 6 is cut between a master or jumbo roll (not shown in detail) and the material web roll stack 5. The front end of the separated material web 6 is held in place with the aid of the clamping device 26 so that the material web 6 is already positioned for the production of the next roll batch. The rear end of the material web 6, which is still being drawn onto the material web roll stack 5, is given an application of adhesive 27. The carrier rolls 2, 3 are again rotated. The adhesive spot of the rear end of the material web roll stack 5 passes between the respective nips of the material web roll stack 5 and the two carrier rolls 2, 3, producing "end sheet adhesion", thereby concluding the roll production process.

The packaging web dispenser 10 is moved to an end of the material web roll, which can occur as early as during the winding process. Starting from this position, the packaging web dispenser 10 begins to dispense a packaging web strip 12 approximately 500 mm wide, for example, a wrapping paper strip. Adhesive is applied to the underside of this strip by the adhesive application device 16. The individual material web rolls 5A, 5B, 5C continue rotating. The packaging web 12 is moved to where it reaches the nip between the pressure roller 9 and the material web rolls 5A, 5B, 5C so that the packaging web adheres to an outermost individual material web roll 5A, 5B, 5C at its circumference.

During the packaging process, the longitudinal edge 22 creates an acute angle with the circumferential direction of rotation 23 of the material web rolls, as discussed supra. While the carrier rolls 2, 3 continue to rotate, the packaging web dispenser 10 slowly travels to an opposite end of the material web roll stack 5 so that the packaging web strip 12 is guided in a helix around all individual rolls 5A, 5B, 5C axially adjacent to one another. The feed rate of the packaging web dispenser 10 is adjusted such that the adjacent wrap layers of the packaging web strip 12 overlap by approximately half the width of the packaging web strip. Double-layer packaging is thus created. During the packaging process, the packaging web 12 is continuously provided with adhesive in such a way that adjacent packaging web strips are glued together. The bottom layer of the packaging web is glued to the circumference of the material web rolls.

When all individual material web rolls 5A, 5B, 5C (shown in FIG. 3) of a "batch" have been provided in this manner with a continuous packaging web sleeve, the final packaging web strip is cut with the aid of the cut-off device 17. The front end of the packaging web 12 is held with the aid of the pair of pinch rollers 15.

The circular blades 18 are lowered to the circumference of the material web roll stack 5 with the aid of the piston/cylinder device 20. Since the blades 18 are positioned where adjacent material web rolls 5A, 5B, 5C are separated from one another, the packaging web sleeve is cut precisely between the individual material web rolls. The individual rolls that hitherto had been joined by the wrapping are thus separated again, but now have circumferential packaging that extends along the entire axial length of each individual material web roll 5A, 5B, 5C.

Since the adjacent material web rolls customarily have a space between them in the range of a approximately one millimeter to approximately one centimeter, a slight overhang of the packaging web 12 results, which is not critical, however.

When the packaging web 12 has been guided so that it completely covers the individual material web rolls 5A, 5B, 5C at each end of the web roll stack 5, blades 18 can be provided at these locations in order to cut off the overhanging three-cornered endpieces which overhang. This cutting can occur simultaneously with the separation of the individual rolls 5A, 5B, 5C.

In alternative embodiments, it is also possible to move the blade 18 along the rail 8 and to individually separate the rolls 5A, 5B, 5C one at a time.

Once the individual rolls 5A, 5B, 5C are again separated, the rotation of the carrier rolls 2, 3 is stopped and the circumferentially packed individual rolls are ejected in a known manner (not shown in detail). In a subsequent, separate station, these individual rolls 5A, 5B, 5C are provided with end covers and edge protectors.

To produce a new "batch," the carrier rolls 2, 3 are again rotated and the front end of the material web 6 is pushed past the first carrier roll 2 into the winding bed 4. A new tube 25, preglued in a known manner, is placed in the winding bed 4. As soon as the adhesive spot comes into contact with the web 6, the sleeve carries the web along and a new roll production process begins.

Figure 2:
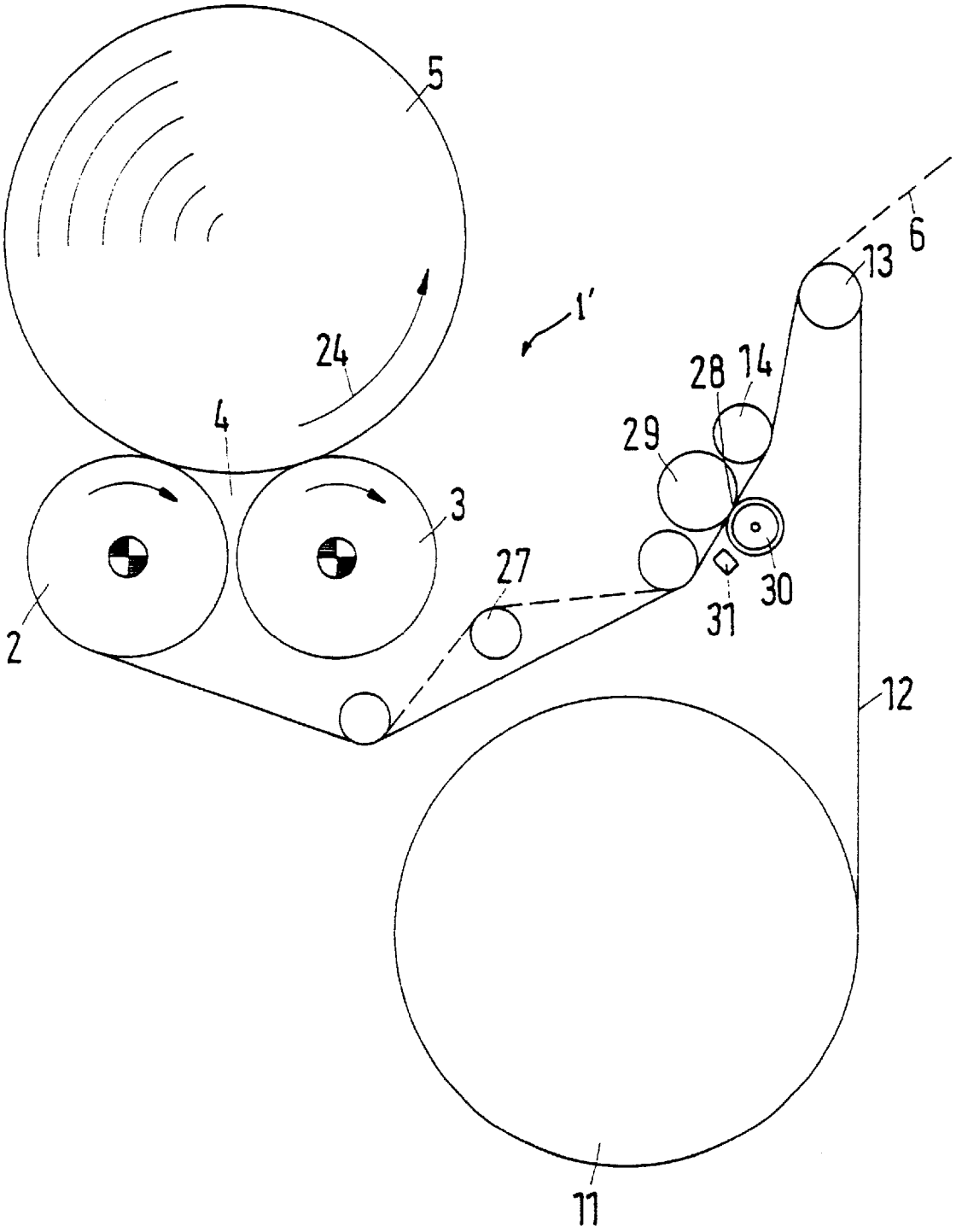
FIG. 2 shows a second embodiment of the device for winding and packaging material web rolls.
Figure 3:
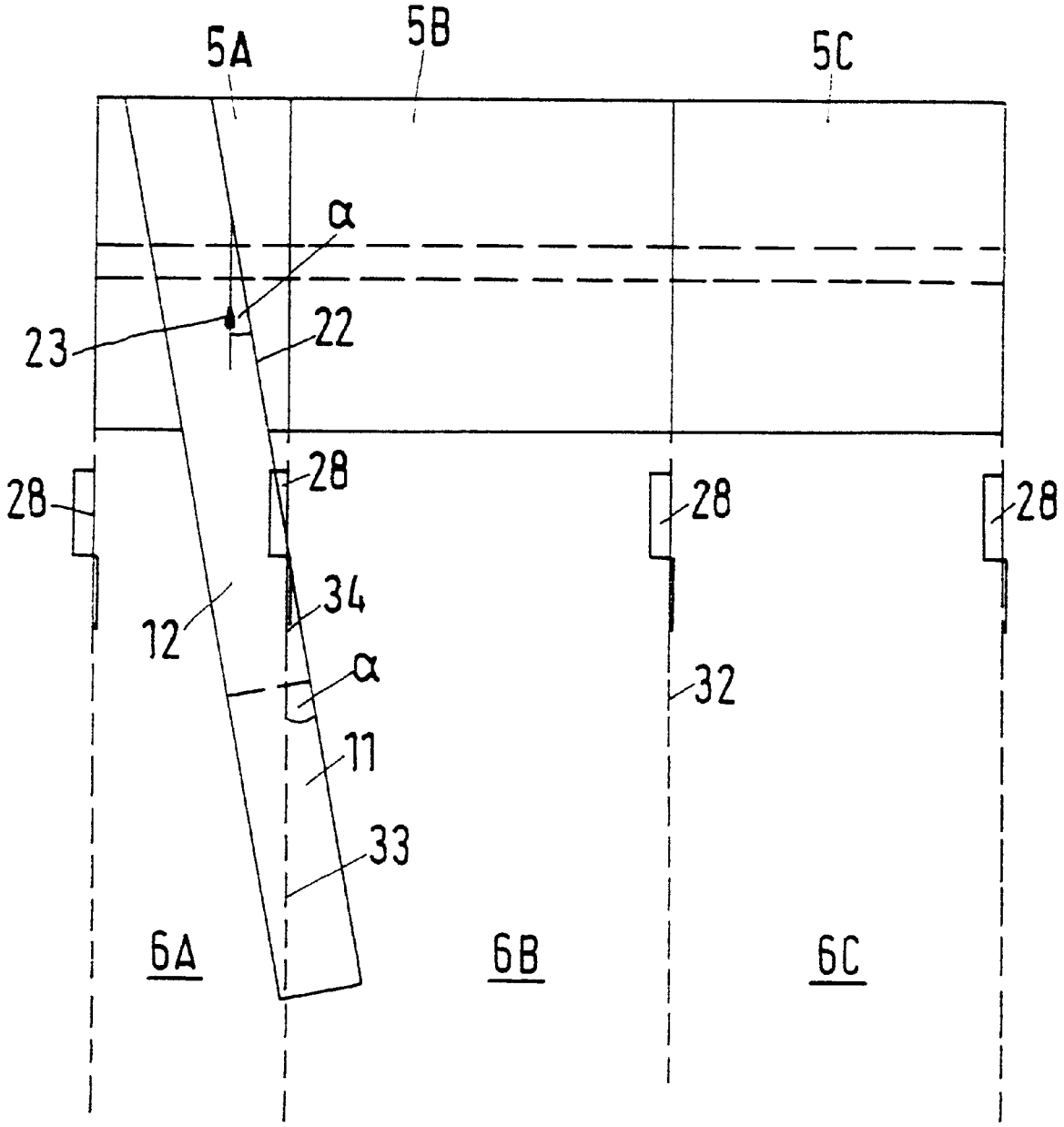
FIG. 3 shows a top view of the device shown in FIG. 2.

FIG. 2 shows a second embodiment of a material web roll packaging device 1', in which like parts are indicated using the same reference numerals as in FIGS. 1 and 3. The path of the material web 6 is shown in dashed lines, the material web being additionally guided over a spreader roll 27.

In the second embodiment, the packaging web roll 11 is not arranged on a loading rail above the material web roll stack 5, but is located below the feed path of the material web 6. The material web 6 is guided over several guide rollers 13, 14 and also passes through a slitting station 28 having top blade 29 and bottom blade 30. A sensor 31 that detects whether a web 6 is present between top blade 29 and bottom blade 30, is located directly downstream from the slitting station 28.

While the packaging web 12 travels the same path as the material web 6 through the slitting station 28, it is not necessary for the packaging web 12 to also be guided over the spreader roller 27.

The operation of the material web roll packaging device 1' is shown in FIG. 3. Shown is a "batch" with three individual material web rolls 5A, 5B, 5C, the rolls being wound from individual material web strips 6A, 6B, 6C, which are slit to a desired width with the aid of four slitting devices 28. Each slitting device 28 generates a cutting line 32.

The packaging web 12 is not guided parallel to the strips 6A, 6B, 6C. The packaging web 12 is guided at the acute angle which the leading side edge 22 of the packaging web 12 forms with the circumferential direction 23 of rotation of the material web roll stack 5. As described supra, the packaging web roll 11 travels parallel to the axis of rotation of the material web rolls 5A, 5B, 5C during winding.

During the winding process, the packaging web 12 also runs through the slitting station 28. Accordingly, the packaging web 12 is cut along cutting line 33 which creates the same angle $\alpha$ with the side edge 22 as with the circumferential direction 23. Thus, a separating line results within the packaging web 12 that runs in such a way that the packaging web 12 is cut at the end face of the material web roll to be packaged (shown here at 5B). During this cutting, however, a point 34 is produced, often resulting in difficulty in handling of the individual web rolls 5A, 5B, 5C.

To reduce the possibility of creating this point 34, the sensor 31 may be configured to influence the slitting station 28 such that the top blade 29 and bottom blade 30, for example, only move toward one another once the edge 22 has passed the sensor 31. Thus, although the cutting line 33 is interrupted at the start, the remaining connected region extends over the edge by only a few centimeters, which is sufficient to guide the point 34 to the material web roll 5B, but is still small enough that this connection will, at the latest, tear apart when the material web rolls 5A, 5B, 5C are ejected from the winding bed 4. Alternative methods of eliminating the point may also be used. For example, the entire cutting line 33 may be perforated so that the packaging tears there when the material web rolls 5A, 5B, 5C are ejected. Also, an adhesive strip may be applied after it passes through the slitting station 28 in order to reconnect the two parts of the packaging web 12 to one another.

FIG. 3 also shows the schematic sequence of winding as it is performed with the material web packaging device 1 of the first embodiment. The only difference is the guiding of the packaging web roll 11, which in the first embodiment is above the material web roll stack 5 on the rail 8, and in the second embodiment is elsewhere.

The invention is described using a paper web as an example. However, the invention can also be used for other material webs such as films of plastic or metal, or for cardboard webs.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for packaging individual material web rolls, comprising:

winding the material web rolls about an axis, from strips created by a longitudinal slit, the individual material web rolls positioned adjacent one another in a roll stack, the roll stack having a pair of roll stack end faces, and each individual material web roll having a pair of end faces;

helically wrapping a packaging web about the circumference of the stack of material web rolls, the stack of material web rolls being in substantially the same position in which they are wound; and separating the packaging web at a position corresponding to the respective end faces of each material web roll, wherein the packaging web is guided over at least one end face of the stack.

2. The process according to claim 1, further comprising guiding the packaging web from before one roll stack end face, to past another roll stack end face; and cutting the packaging web parallel to at least one roll stack end face.

3. The process according to claim 1, further comprising cutting the packaging web located on the circumference of the roll stack.

4. The process according to claim 3, further comprising cutting the packaging web after completion of packaging.

5. The process according to claim 1, further comprising cutting the packaging web as it is supplied;

coordinating the feed rate of the packaging web with the movement of the packaging web parallel to the axis of rotation of the stack;

forming at least one separating line parallel to at least one end face of an individual material web roll.

6. The process according to claim 5, further comprising passing the packaging web through the same slitting device through which the material web passes.

7. The process according to claim 5, further comprising holding together, at least in the region of a leading edge of a packaging web, adjacent packaging web sections on both sides of the separating line.

8. A process for packaging individual material web rolls, comprising:

winding the material web rolls about an axis on a winding bed, from strips created by a longitudinal slit, the individual material web rolls positioned adjacent one another in a roll stack, the roll stack having a pair of roll stack end faces, and each individual material web roll having a pair of end faces;

helically wrapping a packaging web about the circumference of the entire stack of material web rolls, the stack of material web rolls being in substantially the same position in which they are wound; and separating the packaging web at a position corresponding to the respective end faces of each material web roll, wherein the packaging web is dispensed from the same side and the strips so as to travel through the winding bed with the strips.

9. A device for the production and packaging of material web rolls, comprising:

a slitting station configured to slit a material web into a plurality of strips;

a winding bed adapted to accommodate a stack of individual material web rolls next to one another, each material end roll having a pair of end faces;

a packaging web dispenser adapted to travel, in at least one direction, parallel to the longitudinal axis of the stack of individual material web rolls, and further adapted to dispense a packaging web at a predetermined angle to a circumferential direction of rotation to wrap the entire stack of individual material web rolls; and a cutting device adapted to cut the packaging web parallel to the end faces of the material web roll, wherein the packaging web is dispensed from the same side and the strips so as to travel through the winding bed with the strips.

10. A device for the production and packaging of material web rolls, comprising:

a slitting station configured to slit a material web into a plurality of strips;

a winding bed adapted to accommodate a stack of individual material web rolls next to one another, each material end roll having a pair of end faces;

a packaging web dispenser adapted to travel, in at least one direction, parallel to the longitudinal axis of the stack of individual material web rolls, and further adapted to dispense a packaging web at a predetermined angle to a circumferential direction of rotation of the stack of individual material web rolls; and a cutting device adapted to cut the packaging web parallel to the end faces of the material web roll, wherein the packaging web dispenser guides the packing web over the end faces of the stack.

11. The device according to claim 10, wherein the packaging web dispenser is arranged on a rail above said winding bed.

12. The device according to claim 11, wherein said cutting device is arranged on said rail.

13. The device according to claim 11, wherein said cutting device has a circular blade adapted to be moved at least toward the stack in a generally radial direction.

14. The device according to claim 13, wherein said circular blade is further adapted to be moved away from the stack in a generally radial direction.

15. The device according to claim 11, wherein said rail carries a loading roller which forms a nip with the stack of individual material web rolls during winding, the nip adapted to accept the packaging web therethrough.

16. The device according to claim 10, wherein packaging web and the material web share at least a portion of the same path of travel.

17. The device according to claim 16, wherein said cutting device is formed by the slitting station.

18. The device according to claim 17, wherein said slitting station comprises a sensor adapted to detect the passage of a leading side edge of the packaging web.

19. The device according to claim 10, wherein the packaging web dispenser is adapted to travel in two directions parallel to the axis of the stack.

* * * * *